United States Patent [19]

Ichikawa

[11] Patent Number: 4,575,018

[45] Date of Patent: Mar. 11, 1986

[54] APPARATUS FOR HANDLING PHOTOGRAPHIC FILM

[75] Inventor: Koji Ichikawa, Kanagawa, Japan

[73] Assignee: Fuji Photo Film Co., Ltd., Kanagawa, Japan

[21] Appl. No.: 691,039

[22] Filed: Jan. 14, 1985

[30] Foreign Application Priority Data

Jan. 30, 1984 [JP] Japan ..... 59-14921

[51] Int. Cl.[4] ..... B65H 18/16; B65H 19/30

[52] U.S. Cl. ..... 242/66; 242/55; 242/67.1 R; 242/58; 242/68

[58] Field of Search ..... 242/67.1 R, 66, 65, 242/58, 58.6, 56 R, 55, 68, 68.4, 181, 35.5 A, 79, 80; 414/729, DIG. 911

[56] References Cited

U.S. PATENT DOCUMENTS

| | | | |
|---|---|---|---|
| 2,652,208 | 9/1953 | Fitch | 242/66 |
| 3,373,785 | 3/1968 | Anderson | 414/729 X |
| 3,380,685 | 4/1968 | Crist et al. | 242/68 X |
| 3,712,553 | 1/1973 | Napor et al. | 242/56 R |
| 3,823,888 | 7/1974 | Zangenfeind | 242/55 |
| 3,879,925 | 4/1975 | Yoshizawa et al. | 242/35.5 A |
| 3,883,054 | 5/1975 | Butschek | 242/55 X |
| 4,494,706 | 1/1985 | Becherer et al. | 242/67.1 R X |

*Primary Examiner*—John M. Jillions

*Attorney, Agent, or Firm*—Sughrue, Mion, Zinn Macpeak & Seas

[57] ABSTRACT

Disclosed is a means for rewinding on its associated spool, when necessary, a film, which has been unwound from the spool for feeding to a subsequent process, and storing the film, together with the spool, in a storing means. The film is rewound by a rewinding means while the portion of the film on the outer periphery of the spool is being held by the rewinding means, thereby preventing the film from undesirably unwinding. A gripping means transfers this rewound film to a clamping member of the storing means, whereby the rewound film is stored in the storing means.

25 Claims, 4 Drawing Figures

APPARATUS FOR HANDLING PHOTOGRAPHIC FILM

BACKGROUND OF THE INVENTION

1. Field of the Invention

The present invention relates to a photographic film handling apparatus which rewinds a photographic film on the spool, the film having been unwound therefrom, and stores the rewound film in a storing means.

2. Description of the Prior Art

To develop exposed photographic films, first, the cap of the cartridge which contains each film is removed, and the film is unloaded therefrom in its state of being wound on the spool. Then, the films, having been unwound from their respective spools, are successively spliced together by a splicer such as to form a long continuous film.

In this operation, if a film unwound from the spool is in an undesirable condition, for example, if the film is bent or is torn at its edge, or any portion between the adjacent holes constituting the perforation is cut, it is necessary to rewind such film on the spool and to put aside the rewound film in order to subject it to a developing operation which is different from the ordinary one.

In such cases, since it has been unloaded from the cartridge, the film rewound on the spool may undesirably unwind if the rewound film is left as it is. It is, therefore, necessary to prevent such unwinding of the film. Further, it is necessary to successively store the films which are to be put aside in a place where they will not interfere with the operation of the splicing mechanism, so that they can be quickly taken out when the apparatus is at rest.

Thus, a film handling mechanism, which puts aside and stores defective rewound films as described above, needs to be simple and small in size so that it will not take up space.

SUMMARY OF THE INVENTION

Accordingly, it is a primary object of the present invention to provide a photographic film handling apparatus with a simple structure which rewinds on the spool a defective film, such as a bent or torn film, in a state wherein the spool is in the position in which it is set when effecting unwinding of the film, whereby films rewound on the spools can be successively put aside and stored in a cartridge case or similar storing means without any possibility that the rewound films may undesirably unwind.

To this end, according to the present invention, there is provided a photographic film handling apparatus in which a flanged spool having one end of a film secured thereto is held by a spool holding means at portions of the shaft of the spool outward of the flanges, and the film is rewound by a rewinding means in a state wherein the portion of the film on the spool is held by the rewinding means at the outer periphery of the film, and then a gripping means clamps the rewound film being held by the spool holding means and takes the former away from the latter by means of a resilient biasing force. After the gripping means has been shifted from the spool receiving position to a spool transfer position by a shifting means, the film being gripped by the gripping means is transferred to a clamping member provided at the inlet of a film storing means. The clamping member has a resilient biasing force which is stronger than that of the gripping means so that the film can be taken away from the gripping means and stored in the storing means.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT

One embodiment of the present invention will be described hereinunder in detail.

Figure 1:
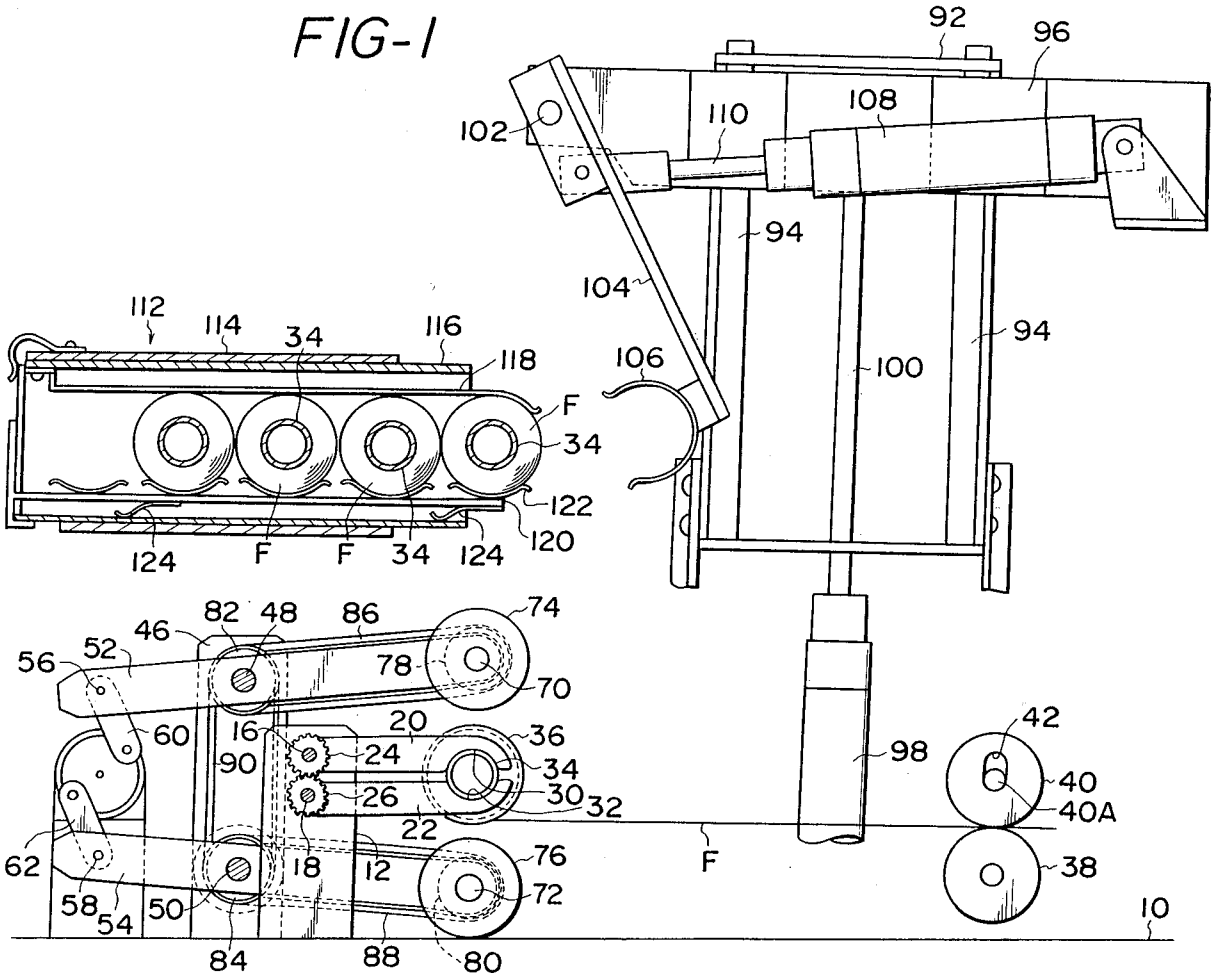
FIG. 1 is a partly-sectioned front elevational view (corresponding to a sectional view taken along the line I—I of FIG. 3) of one embodiment of the photographic film handling apparatus according to the present invention.
Figure 2:
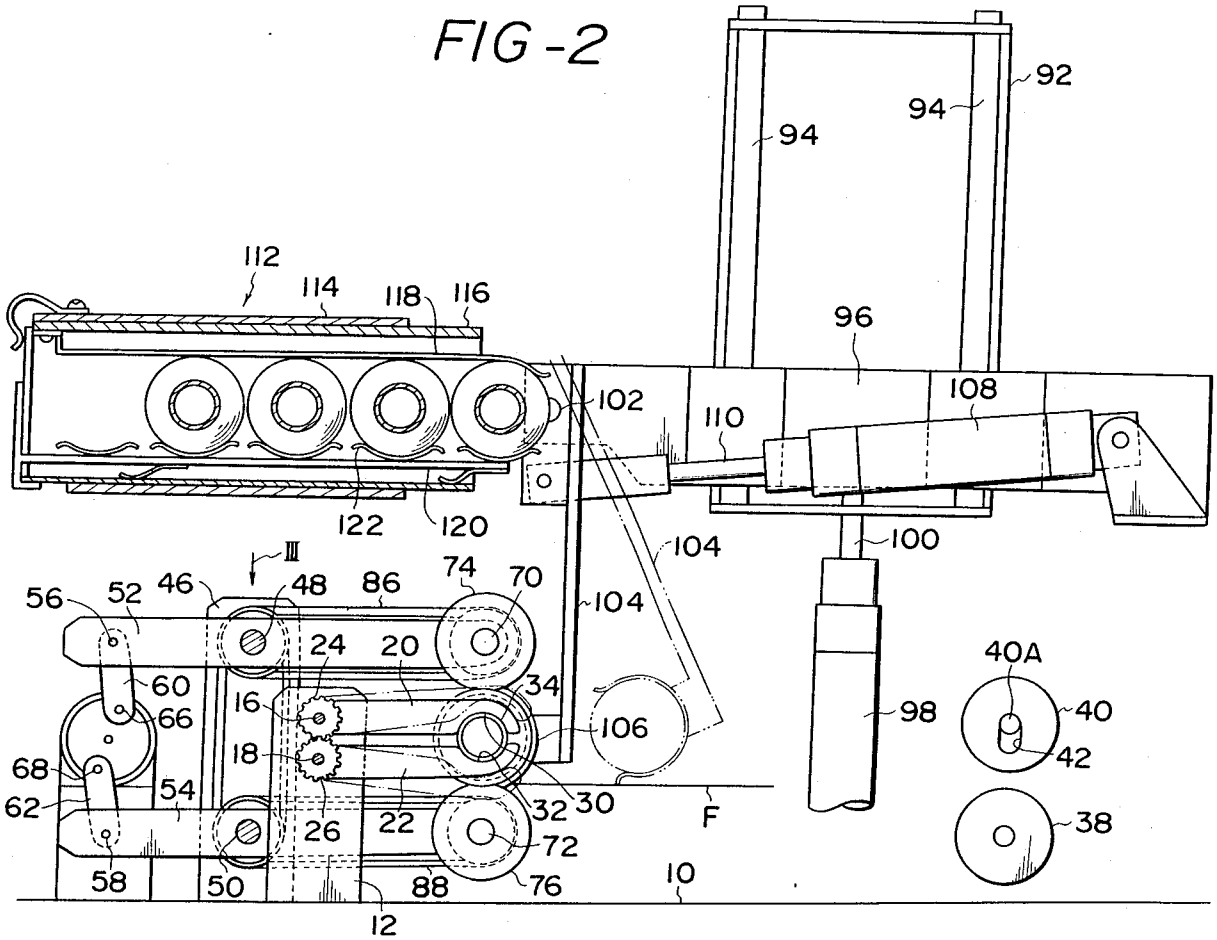
FIG. 2 is an illustration of the photographic film handling apparatus shown in FIG. 1 in an operative state.
Figure 3:
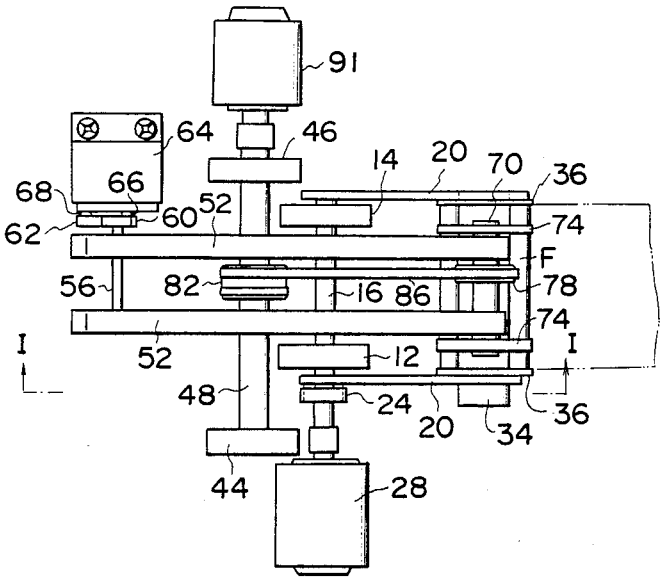
FIG. 3 is an illustration of an essential part of the photographic film handling apparatus as viewed in the direction of the arrow III of FIG. 2.

Referring to FIGS. 1 to 3, on a base plate 10 stand a pair of brackets 12, 14 opposing each other. Upper and lower shafts 16, 18 are rotatably supported by these brackets 12, 14 in such a manner that their respective axes are horizontal and parallel to each other.

To the shaft 16 are secured the respective proximal portions of a pair of spool chucks 20 with a proper spacing therebetween; to the shaft 18 are secured the respective proximal portions of a pair of spool chucks 22 such that they correspond with the spool chucks 20. These spool chucks 20, 22 are pivoted by the same angle in opposite directions to each other by the driving force of a motor 28 connected to the shaft 16 through a pair of pinions 24, 26 which are respectively secured to the shafts 16, 18. The motor 28 is supported by the base plate 10 through a bracket (not shown).

The spool chucks 20, 22 respectively have semicircular recesses 30, 32 formed in their opposing surfaces at the respective distal end portions so that the recesses 30, 32 can hold the outer periphery of a film takeup spool 34 in cooperation with each other. More specifically, the spool 34 has a pair of flanges 36 respectively projecting from portions of the spool 34 near both its axial ends, and the spool 34 is rotable while being held at its shaft portions outward of the flanges 36 by the spool chucks 20, 22. Thus, the spool chucks 20, 22 in combination constitute a means for holding the spool 34.

One end of a photographic film F is retained by the spool 34 at a portion between the flanges 36 which are located near both axial ends of the spool 34. The retained end portion of the film F is wound up on the spool 34 in layers. On the other hand, the leading end of the photographic film F is unwound off the spool 34 and is held in the area between a driving roller 38 and a driven roller 40. The film F is successively unwound from the spool 34 by the rotation of the driving roller 38 such that it is fed to a developing unit (not shown). The driven roller 40 has its shaft 40A guided by a slot 42 such as to be movable toward and away from the driving roller 38. To feed the photographic film F to the developing unit, the driven roller 40 is pressed against the driving roller 38; to rewind the film F on the spool 34, as shown in FIG. 2, the shaft 40A is moved in the slot 42 toward the other side such that the driven roller 40 is separated from the driving roller 38, whereby the film F is released from the hold by the rollers 38, 40.

It is to be noted that the leading end portion or tongue of the photographic film F wound on the spool 34 is searched and caught by a tongue catching means (not shown) and is then guided to the area between the driving roller 38 and the driven roller 40.

A pair of brackets 44, 46 stand on the base plate 10 in close proximity to the brackets 12, 14. Upper and lower shafts 48, 50 are rotatably supported by these brackets 44, 46 in such a manner that their respective axes are horizontal and parallel to each other. To these shafts 48, 50 are respectively secured intermediate portions of pairs of arms 52, 54.

One of the ends of small arms 60, 62 are pivotally supported at one of the ends of the arms 52, 54, respectively, through pins 56, 58. The other ends of the small arms 60, 62 are pivotally supported by output shafts 66, 68, respectively, of a rotary solenoid 64.

On the other hand, shafts 70, 72 are rotatably supported at the other ends of the arms 52, 54. Nip rollers 74, 76 are respectively secured to the shafts 70, 72 such as to rotate with the shafts 70, 72.

Further, pulleys 78, 80 are respectively secured to the shafts 70, 72. V-belts 86, 88 are respectively stretched between the pulleys 78, 80 and corresponding pulleys 82, 84 which are rotatably supported by the shafts 48, 50, respectively. In addition, a V-belt 90 is stretched between the pulleys 82, 84. The shaft 50 is connected with the output shaft of a motor 91 such that the shaft 50 can be rotated by the driving force of the motor 91. The motor 91 is supported by the base plate 10 through a bracket (not shown).

Accordingly, the turning force of the motor 91 can be transmitted to the nip rollers 74, 76, and when the arms 52, 54 are pivoted by the driving force of the rotary solenoid 64, the nip rollers 74, 76 are moved from the positions shown in FIG. 1 to the positions shown in FIG. 2 such as to abut against the portion of the photographic film F still wound on the outer periphery of the spool 34, whereby the film F can be rewound on the outer periphery of the spool 34. Thus, the nip rollers 74, 76 in combination constitute a means for rewinding the photographic film F on the spool 34.

As shown in FIG. 1, a guide bracket 92 is provided above the base plate 10. To the guide bracket 92 are secured a pair of guide bars 94 in such a manner that their respective axes are vertical. A moving plate 96 is vertically movably guided by these guide bars 94. To the moving plate 96 is secured a plunger 100 of a pneumatic cylinder 98 which is secured to the base plate 10 such that the moving plate 96 can be vertically moved by the driving force of the pneumatic cylinder 98.

Figure 4:
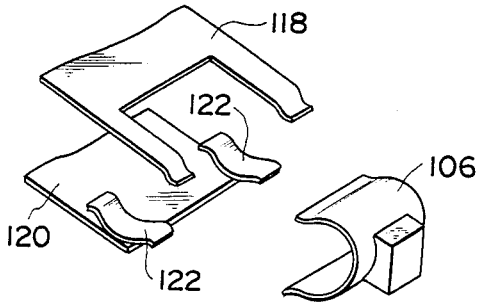
FIG. 4 is a perspective view showing the correspondence between a clamping member and a gripping means.

A gripping arm 104 is pivotally supported at one end thereof by the moving plate 96 through a shaft 102. To the distal end portion of the gripping arm 104 is secured the central portion of a gripping plate 106 constituted by a leaf spring having the shape of a 'C' which defines a circular arc larger than a semicircle, as shown in FIG. 4 also. Both end portions of the gripping plate 106 are bent slightly outwardly so that the spool 34 can be easily fitted into the gripping plate 106.

To the gripping arm 104 is secured a plunger 110 of a pneumatic cylinder 108 which is secured to the moving plate 96 so that the arm 104 can be pivoted about the shaft 102 by the driving force of the pneumatic cylinder 108.

In this case, the gripping plate 106 constitutes a means for gripping the spool 34 being held by the spool chucks 20, 22 and takes the former away from the latter. The gripping means is movable by the driving force of the pneumatic cylinder 98 between a receiving position where the gripping means receives the spool 34 from the spool chucks 20, 22, as shown in FIG. 2, and a transfer position where the gripping means transfers the spool 34 to a storing means 112 disposed above the nip rollers 74 as shown in FIG. 1. Thus, the moving plate 96 and the pneumatic cylinder 98 in combination constitute a means for shifting the gripping means.

The following is a description of the storing means 112. The storing means 112 includes a rectangular storing box 114 which is secured to the base plate 10. A cartridge case 116 is received in the storing box 114. The cartridge case 116 is hollow and open at its distal end portion which opposes the gripping plate 106. From the opening portion project the respective distal end portions of a pair of retainer plates 118, 120 which are retained by the bottom portion of the cartridge case 116. The retainer plate 118 is constituted by a leaf spring. As shown in FIG. 4 also, the retainer plate 118 forks at its distal end in such a manner that the span between the forked end portions is larger than the width of the gripping plate 106. In addition, the forked end portion is bent toward the retainer plate 120 so that it can press against the spool 34 transferred from the gripping plate 106 against the retainer plate 120. To the retainer plate 120 are secured, at proper spacings, a plurality of circular leaf springs 122 in correspondence with a plurality of spools 34 to be transferred thereto, whereby each spool 34 can be received in position and spools 34 being transferred can be successively moved toward the inner side of the cartridge case 116.

In this case, the distal end portions of the retainer plate 118 and the circular leaf springs 122 secured to the distal end portion of the retainer plate 120 serve as clamping members which clamp each spool 34 transferred by means of a biasing force larger than that of the gripping plate 106.

It is to be noted that, although the retainer plate 120 is biased toward the retainer plate 118 by leaf springs 124 interposed between the retainer plate 120 and the corresponding wall of the cartridge case 116, it is possible to draw out the spool 34 from the cartridge case 116 as desired by moving the retainer plate 120 away from the retainer plate 118 against the biasing force of the leaf spring 124.

The operation of the above-described embodiment will be described hereinunder.

FIG. 1 shows the film handling apparatus in a state wherein the spool 34 for the photographic film F unloaded from the associated cartridge has already been held by the spool chucks 20, 22. The photographic film F has its leading end held by the driving roller 38 and the driven roller 40. As the driving roller 38 is rotated, the photographic film F is successively unwound from the spool 34 and is fed to the developing unit (not shown).

However, if the photographic film F is bent or torn at any portion thereof, it is necessary to rewind the film F on the spool 3 and to put aside the same. In such cases, as shown in FIG. 2, the rotary solenoid 64 is actuated, whereby the nip rollers 74, 76 abut against the portion of the film F wound on the outer periphery of the spool 34. In addition, the driven roller 40 is separated from the driving roller 38. At the same time, the nip rollers 74, 76 are rotated in opposite directions by the driving force of the motor 91, whereby the unwound portion of the film F is rewound on the outer periphery of the spool 34.

At this time, the pneumatic cylinder 98 moves the gripping arm 104 from the transfer position shown in FIG. 1 to the receiving position shown by the two-dot chain line in FIG. 2. Then, the gripping arm 104 is pivoted to the position shown by the solid line in FIG. 1 by the driving force of the pneumatic cylinder 108. In consequence, the gripping plate 106 clamps the photographic film F on the spool 34 by the action of its biasing force. After the clamping of the film F has been completed, by the rotation of the motor 28, the spool chucks 20, 22 are moved away from each other to the positions shown by the two-dot chain line in FIG. 2.

Thereupon, the pneumatic cylinder 108 is driven such as to pivot the gripping arm 104 to the position shown by the two-dot chain line in FIG. 2, whereby the gripping plate 106 takes the spool 34 away from the spool holding means while clamping the spool 34.

Then, by the driving force of the pneumatic cylinder 98, the gripping arm 104, together with the moving plate 96, is raised to the transfer position shown in FIG. 1.

At the transfer position, the gripping arm 104 is pivoted again by the driving force of the pneumatic cylinder 108, whereby the spool 34 being clamped by the gripping plate 106 is transferred to the storing means 112. When the spool 34 is clamped between the retainer plates 118, 120 of the storing means 112, the gripping arm 104 is pivoted to the solid-line position shown in FIG. 1, whereby the spool 34 can be transferred to the storing means 112. More specifically, since the retainer plate 118 and the leaf springs 122 of the storing means 112 have a larger biasing force than that of the gripping plate 106, the spool 34 can be taken away from the gripping plate 106.

Thus, spools 34 which should not be fed to the ordinary developing process are successively removed and stored in the storing means 112. Such spools 34 can be taken out from the storing means 112, according to need, by drawing out the storing box 114 from the cartridge case 116 so as to be developed by a process which is different from the ordinary developing process. Thus, the photographic film F on the spool 34 is transferred to the storing means 112 while being prevented from undesirably unwinding by the nip rollers 74, 76, the gripping plate 106 and the storing means 112.

As has been described above, the photographic film handling apparatus according to the present invention includes: the spool holding means which holds the spool; the rewinding means which rewinds the film on the spool while pressing against the outer periphery of the portion of the film already wound on the spool; the gripping means which takes the rewound film, together with the spool, away from the spool holding means, by means of a biasing force; the film storing means which takes the film, together with the spool, away from the gripping means by means of a biasing force which is stronger than that of the gripping means; and the shifting means which shifts the film from the receiving position to the transfer position. Accordingly, it advantageously becomes possible to obtain a simple apparatus which can rewind a defective film on the spool and put aside the rewound film while preventing the film from undesirably unwinding.

I claim:

1. A photographic film handling apparatus which rewinds a photographic film on the associated spool and stores the rewound film in film storing means, comprising:

(a) spool holding means which holds a flanged spool having one end of a film secured thereto at its shaft portions outward of the flanges;

(b) rewinding means which rewinds said film on said spool while pressing against the outer periphery of the portion of said film already wound on said spool in a state wherein said spool is held by said spool holding means;

(c) gripping means which grips said rewound film being held by said spool holding means and takes the former away from the latter;

(d) film storing means including a clamping member which clamps said rewound film being gripped by said gripping means and takes the former away from the latter; and (e) shifting means which shifts said gripping means between a receiving position where said gripping means takes said rewound film away from said spool holding means and a transfer position where said gripping means transfers said rewound film to said clamping member of said film storing means.

2. A photographic film handling apparatus according to claim 1, wherein said spool holding means includes a pair of spool chucks provided such as to correspond to each of the axial ends of the shaft of said flanged spool in order to clamp the corresponding shaft end portion.

3. A photographic film handling apparatus according to claim 2, wherein said pair of spool chucks have semicircular recesses formed at their respective distal end portions such that, when said spool chucks clamp the corresponding shaft end portion of said spool, said recesses abut against the outer periphery of the shaft of said spool.

4. A photographic film handling apparatus according to claim 2, wherein said pair of spool chucks are driven by driving means in such a manner that their respective distal end portions are moved by the same amount, thereby holding and releasing said spool.

5. A photographic film handling apparatus according to claim 1, wherein said rewinding means includes: pressing means which clamps the portion of said film on the outer periphery of said spool from opposite sides across the axis of said spool; and takeup means which winds up said film in a state wherein the outer periphery of the portion of said film already wound is pressed by said pressing means.

6. A photographic film handling apparatus according to claim 5, wherein said pressing means is constituted by a pair of nip rollers which clamp the portion of said film on the outer periphery of said spool from opposite sides across the axis of said spool.

7. A photographic film handling apparatus according to claim 6, wherein said nip rollers also serve as takeup means which is rotated by a driving force such as to rotate said film, together with said spool, thereby winding up said film.

8. A photographic film handling apparatus according to claim 1, wherein said gripping means clamps said rewound film by radially pressing against the outer periphery of said film.

9. A photographic film handling apparatus according to claim 1, wherein said gripping means includes a resilient member having the shape of a circular arc which is larger than a semicircle, thereby taking said rewound film away from said spool holding means while receiving said spool in said circular arc and clamping said spool by means of a biasing force.

10. A photographic film handling apparatus according to claim 1, wherein said clamping member clamps said film being gripped by said gripping means and takes the former away from the latter by means of a resilient biasing force which is stronger than the gripping force applied by said gripping means.

11. A photographic film handling apparatus according to claim 9, wherein said clamping member clamps said film being gripped by said gripping means and takes the former away from the latter by means of a resilient biasing force which is stronger than a biasing force applied by said gripping means.

12. A photographic film handling apparatus according to claim 1, wherein said film storing means includes a storing box and a film storing cartridge case which is drawably fitted in said storing box, and said clamping member is secured to the distal end portion of said cartridge case.

13. A photographic film handling apparatus according to claim 12, wherein said clamping member projects beyond the distal end of said cartridge case so as to clamp said film being gripped by said gripping means and to take the former away from the latter by means of a resilient biasing force which is stronger than the gripping force applied by said gripping means.

14. A photographic film handling apparatus according to claim 13, wherein said clamping member is constituted by a pair of resilient members for clamping said film when said film is transferred from said gripping means.

15. A photographic film handling apparatus according to claim 14, wherein each of said resilient members forks at its distal end in such a manner that the span between the forked end portions is larger than the width of said gripping means, whereby said film being gripped by said gripping means is clamped at both its sides by said forked end portions and is taken away from said gripping means.

16. A photographic film handling apparatus according to claim 15, wherein films already stored in said film storing means are successively moved toward the inner side thereof by being pushed by said film fitted into the area between the distal end portions of said resilient members.

17. A photographic film handling apparatus which rewinds any defective film on the associated cartridge which is detected when photographic films are unwound from the associated cartridges for being subjected to development, fixing and so forth, comprising:

(a) spool holding means which holds a flanged spool having one end of a film secured thereto at portions of said spool near both its axial ends by a pair of spool chucks;

(b) rewinding means which rewinds said film while pressing against the portion of said film on the outer periphery of said spool from opposite sides across the axis of said spool in a state wherein said spool is held by said spool holding means;

(c) gripping means which clamps said rewound film being held by said spool holding means and takes the former away from the latter while radially pressing against the outer periphery of said film;

(d) film storing means having a clamping member which clamps said film being gripped by said gripping means and takes the former away from the latter by means of a film pressing force which is stronger than that of said gripping means; and (e) shifting means which shifts said gripping means between a position where said gripping means receives said film from said spool holding means and a position wherein said gripping means transfers said film to said film storing means.

18. A photographic film handling apparatus according to claim 17, wherein said pair of spool chucks are driven by driving means in such a manner that their respective distal end portions are moved by the same amount, thereby holding and releasing said spool.

19. A photographic film handling apparatus according to claim 17, wherein said rewinding means includes pressing means which is constituted by a pair of nip rollers which clamp the portion of said film on the outer periphery of said spool from opposite sides across the axis of said spool.

20. A photographic film handling apparatus according to claim 19, wherein said nip rollers also serve as takeup means which is rotated by a driving force such as to rotate said film, together with said spool, thereby winding up said film.

21. A photographic film handling apparatus according to claim 17, wherein said gripping means includes a resilient member having the shape of a circular arc which is larger than a semicircle, thereby taking said rewound film away from said spool holding means while receiving said spool in said circular arc and clamping said spool by means of a biasing force.

22. A photographic film handling apparatus according to claim 17, wherein said clamping member projects beyond the distal end of a cartridge case constituting a part of said film storing means so as to clamp said film being gripped by said gripping means and to take the former away from the latter by means of a resilient biasing force which is stronger than the gripping force applied by said gripping means.

23. A photographic film handling apparatus according to claim 20, wherein said clamping member is constituted by a pair of resilient members for clamping said film when said film is transferred from said gripping means.

24. A photographic film handling apparatus according to claim 23, wherein each of said resilient members forks at its distal end in such a manner that the span between the forked end portions is larger than the width of said gripping means, whereby said film being gripped by said gripping means is clamped at both its sides by said forked end portions and is taken away from said gripping means.

25. A photographic film handling apparatus which allows a film once unwound from its associated spool to be rewound thereon and taken out when necessary, comprising:

(a) spool holding means including a pair of spool chucks which are provided in such a manner as to correspond to each of the ends of the shaft of a spool by which one end of a film is retained, these spool chucks moving toward and away from each other, thereby allowing said spool to be held or released from the hold of said spool chucks;

(b) rewinding means including a pair of nip rollers which clamp the portion of said film on the outer periphery of said spool, said nip rollers being adapted to rotate such as to rotate said film, together with said spool, thereby rewinding said film on said spool;

(c) gripping means including a resilient member which has the shape of a circular arc larger than a semicircle, said resilient member being adapted to clamp said film rewound by said nip rollers and to take said film away from said spool holding means;

storing means including a resilient member which clamps the outer periphery of said film being clamped by said gripping means, by means of a biasing force which is stronger than the biasing force applied by said gripping means, and takes away said film from said gripping means, said storing means being capable of storing a plurality of rewound films; and (e) shifting means which shifts said gripping means between a position where said gripping means opposes said spool holding means and a position where said gripping means opposes said storing means.

* * * * *